US007345646B1

(12) United States Patent
Lin et al.

(10) Patent No.: US 7,345,646 B1
(45) Date of Patent: Mar. 18, 2008

(54) ANTENNA HINGE

(75) Inventors: Tzu-Yu Lin, Shulin (TW); Ching-Ho Hsieh, Shulin (TW)

(73) Assignee: Shin Zu Shing Co., Ltd. (TW)

( * ) Notice: Subject to any disclaimer, the term of this patent is extended or adjusted under 35 U.S.C. 154(b) by 0 days.

(21) Appl. No.: 11/649,533

(22) Filed: Jan. 4, 2007

(51) Int. Cl.
*H01Q 3/02* (2006.01)

(52) U.S. Cl. ..... 343/882; 343/878; 248/536

(58) Field of Classification Search ..... 343/878, 343/882, 892; 248/534, 536, 539
See application file for complete search history.

(56) References Cited

U.S. PATENT DOCUMENTS 3,587,104 A * 6/1971 Budrow et al. ..... 343/704

5,787,167 A * 7/1998 Anderson ..... 379/446

* cited by examiner

*Primary Examiner*—Tan Ho
(74) *Attorney, Agent, or Firm*—Jackson Walker, LLP

(57) ABSTRACT

An antenna is mounted on a notebook and has a bracket, a pivot and a spring. The bracket has a sleeve and an arm. The sleeve has a cavity and a rail slot. The radially slot is defined radially through the sleeve and communicates with the cavity. The arm is formed on and extends outward from the sleeve to hold an antenna. The pivot has a chamber. The spring is mounted between the bracket and the pivot and has two ends respectively mounted in the cavity and the chamber. With the antenna hinge, the antenna pointing is adjusted easily and conveniently.

6 Claims, 6 Drawing Sheets

ANTENNA HINGE

BACKGROUND OF THE INVENTION

1. Field of the Invention

The present invention relates to a hinge, and more particularly to an antenna hinge that is mounted in a compact device such as a notebook, holds an antenna and is capable of adjusting an antenna pointing of an antenna.

2. Description of Related Art

Communication technology greatly advances in wireless filed in recent years. Wireless devices such as wireless mice, wireless keyboards, access points and wireless local area network (LAN) cards for computers are common and can be seen everywhere. Furthermore, latest notebooks have a built-in wireless LAN card so that they can communicates with other wireless devices such as access points without an additional wireless LAN card.

Every wireless device needs an antenna to receive wireless signals. Because the wireless device becomes more and more compact, the antenna in the wireless device is smaller and smaller.

A signal-receiving rate of an antenna is relevant to an antenna pointing of the antenna. Therefore, people always need to move the wireless device to adjust the position and rotation of the wireless device to find an optimum antenna point of an antenna on the wireless device in order to obtain a best signal-receiving rate.

However, frequently moving the wireless device in order to find the optimum antenna pointing is laborious and inconvenient.

To overcome the shortcomings, the present invention provides an antenna hinge to mitigate or obviate the aforementioned problems.

SUMMARY OF THE INVENTION

The main objective of the invention is to provide an antenna hinge that is mounted in a compact device such as a notebook, holds an antenna and is capable of adjusting an antenna pointing of an antenna.

An antenna in accordance with the present invention is mounted on a notebook and comprises a bracket, a pivot and a spring. The bracket has a sleeve and an arm. The sleeve has a cavity and a rail slot. The radially slot is defined radially through the sleeve and communicates with the cavity. The arm is formed on and extends outward from the sleeve to hold an antenna. The pivot has a chamber. The spring is mounted between the bracket and the pivot and has two ends respectively mounted in the cavity and the chamber.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
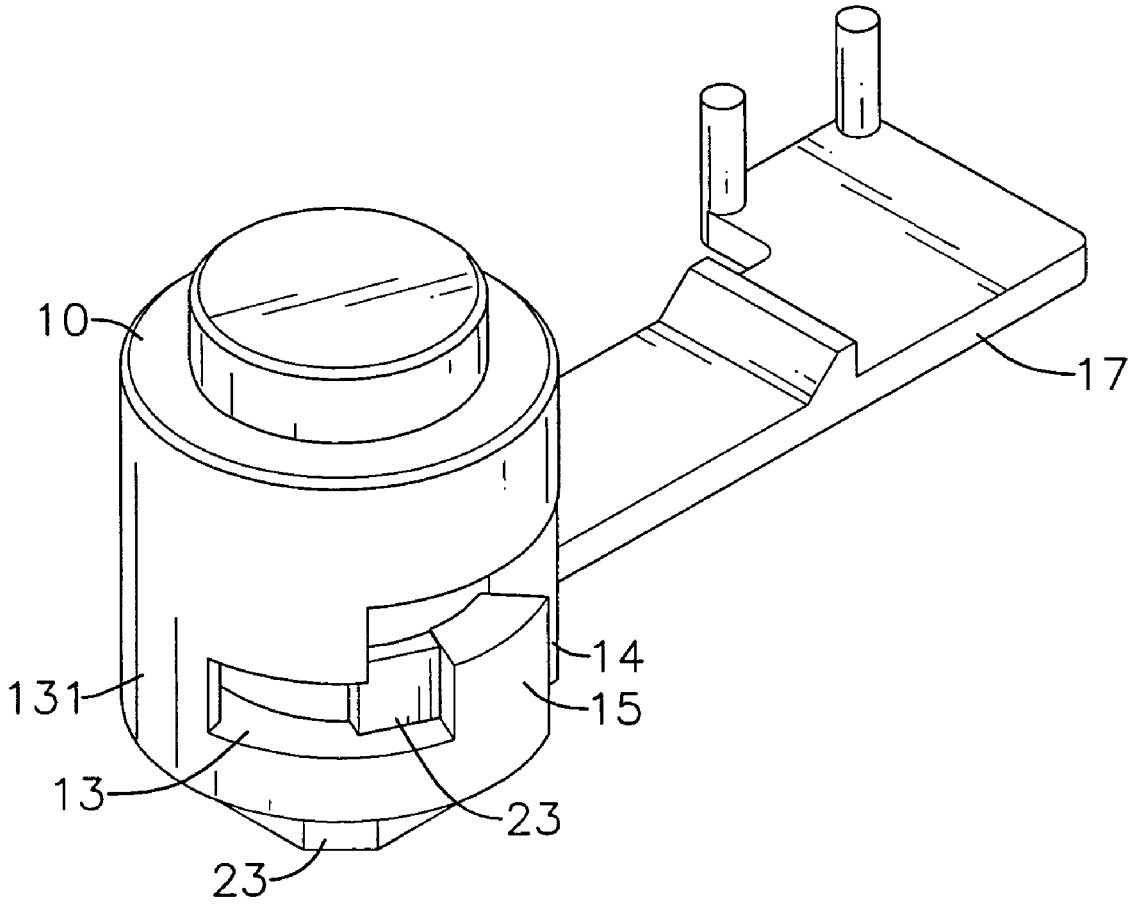
FIG. 1 is a perspective view of an antenna hinge in accordance with the present invention.
Figure 2:
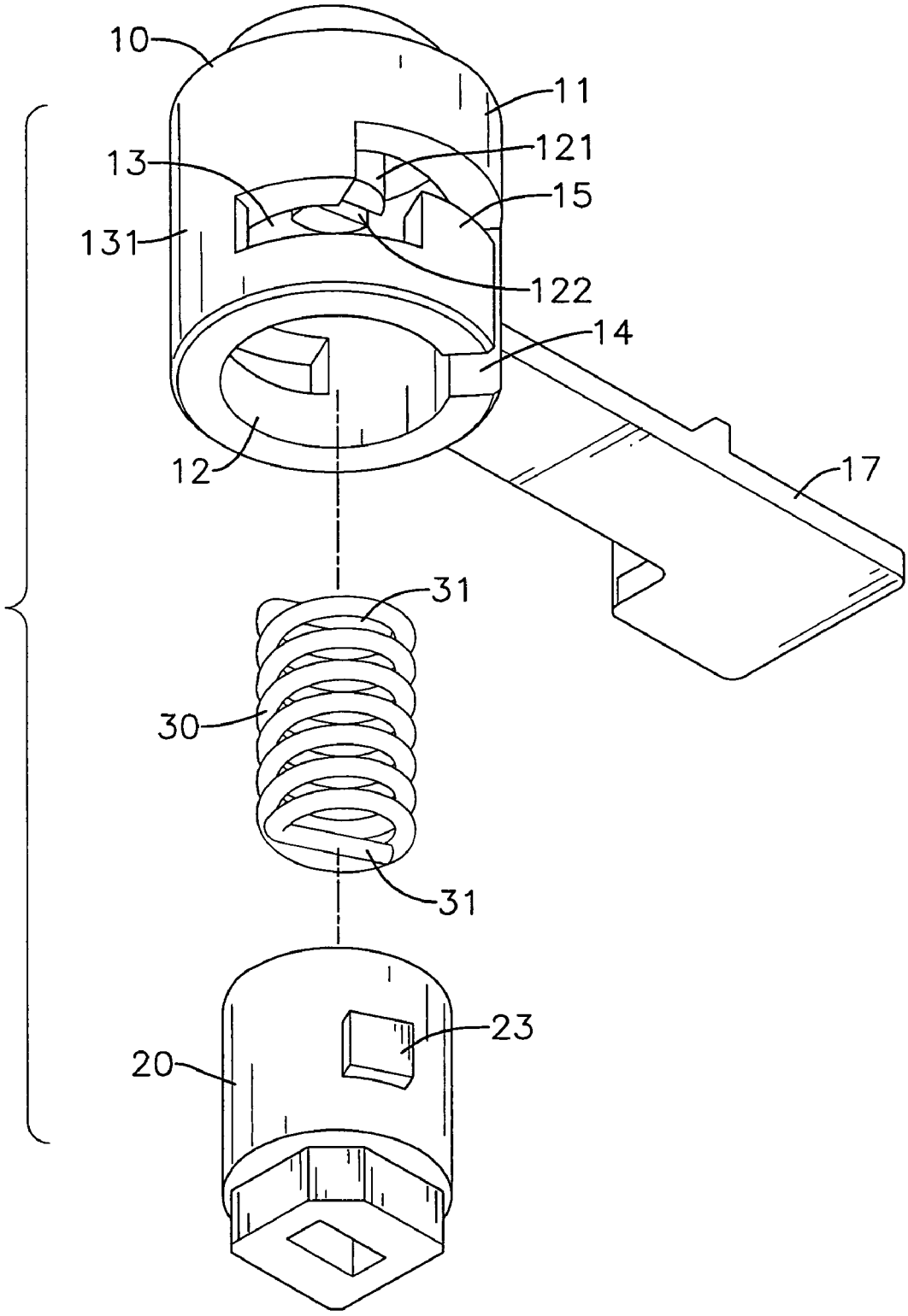
FIG. 2 is an exploded perspective view of the antenna hinge in FIG. 1.
Figure 5:
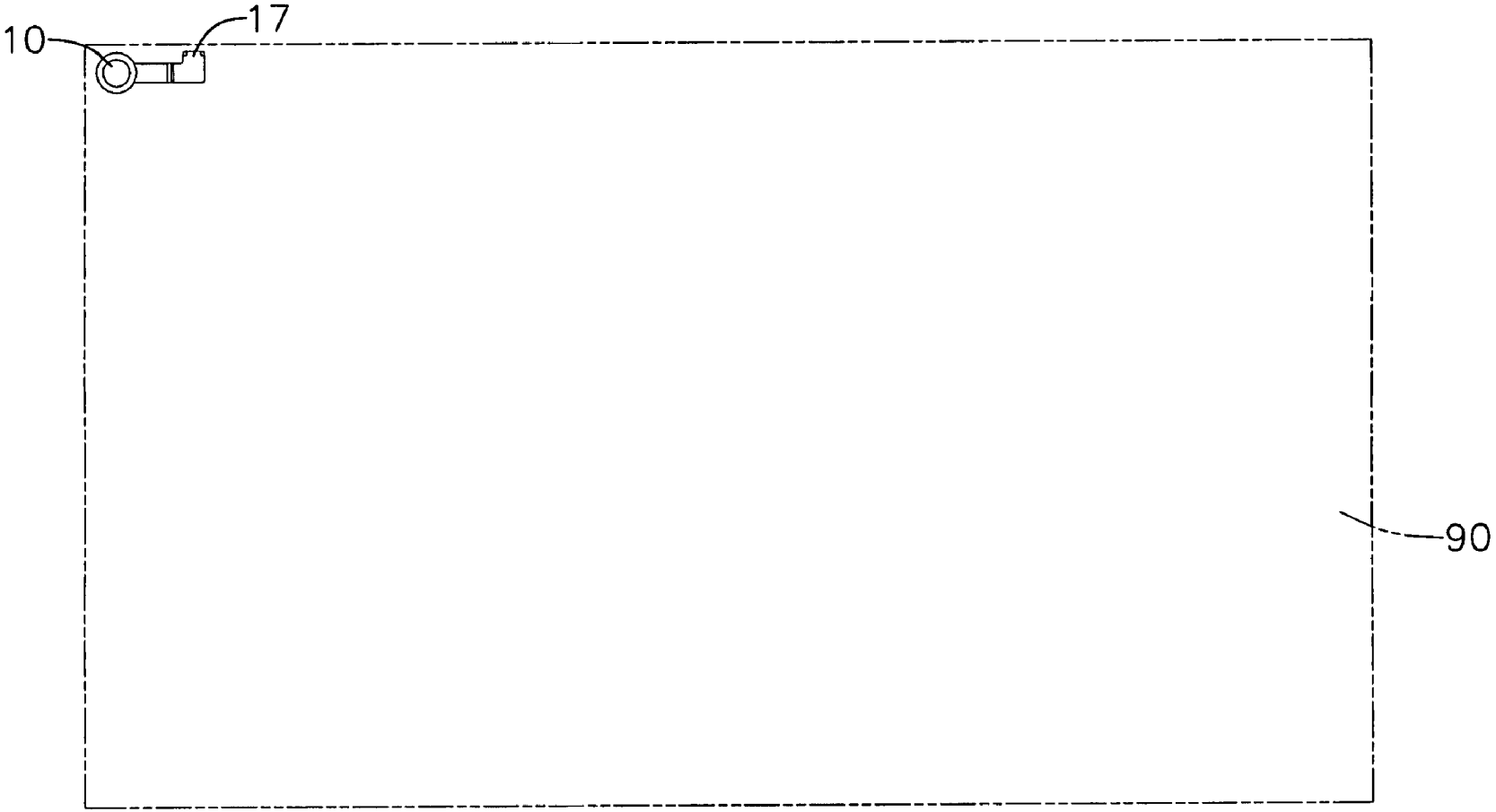
FIG. 5 is an operational view of the antenna hinge mounted in a cover of a notebook.

With reference to FIGS. 1, 2 and 5, an antenna hinge in accordance with the present invention is mounted on a cover (90) of a notebook and may hold an antenna of a wireless device such as a built-in wireless local area network (LAN) card.

The antenna hinge comprises a bracket (10), a pivot (20) and a spring (30).

Figure 3:
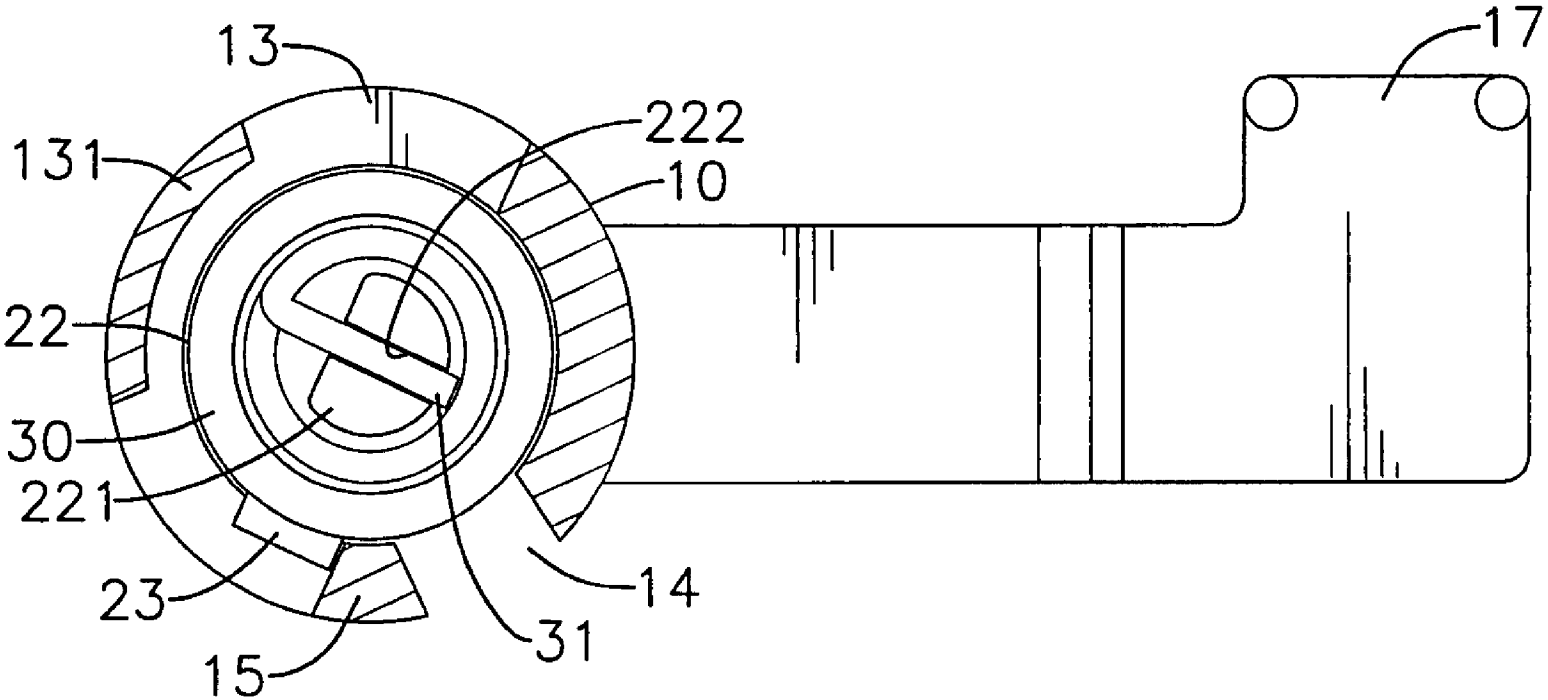
FIG. 3 is a cross sectional top view of the antenna hinge in FIG. 1.
Figure 4:
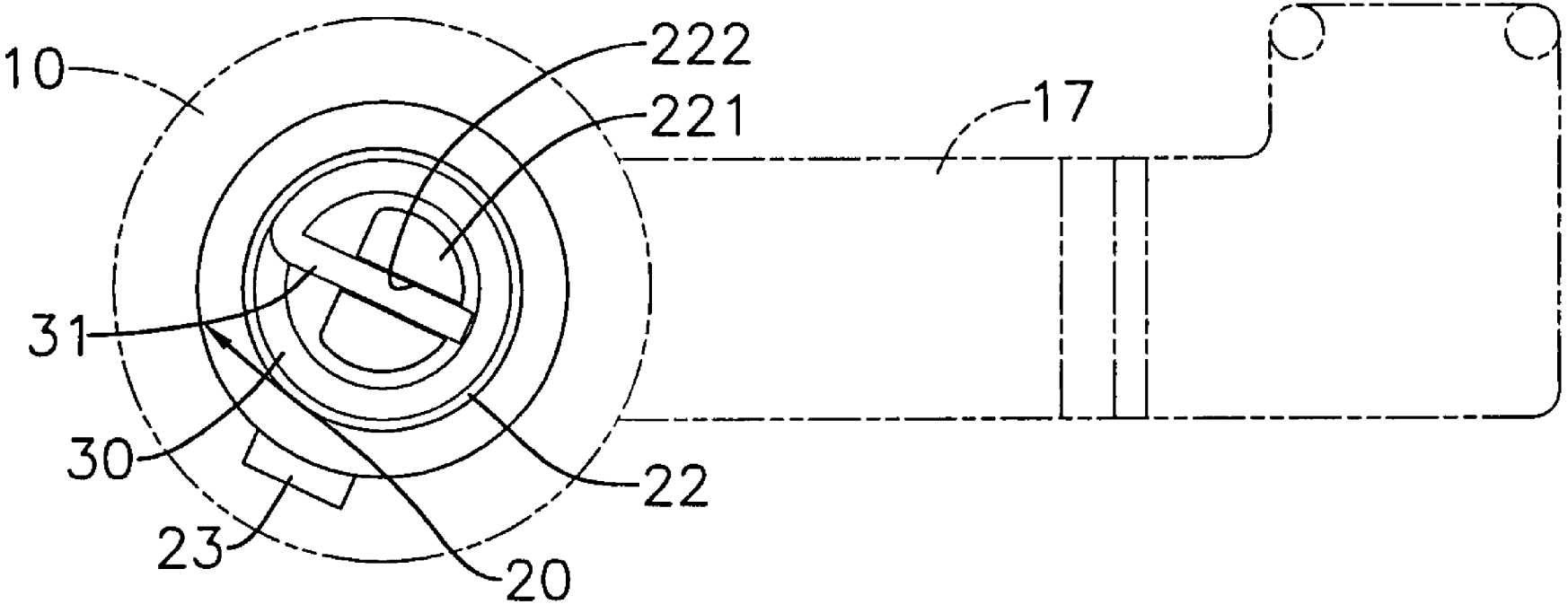
FIG. 4 is a top view of the antenna hinge in FIG. 1.

With reference to FIGS. 2 and 3, the bracket (10) has a sleeve (11) and an arm (17).

The sleeve (11) has an open bottom, a sidewall, a cavity (12), a rail slot (13), a guide slot (14) and a limit (15). The open bottom has an annular bottom edge. The sidewall is annular and has an outer surface. The cavity (12) is formed in the open bottom of the sleeve (11) and has an inner top surface and a retaining protrusion (121). The retaining protrusion (121) is formed on and extends downward from the inner top surface and has a mounting groove (122) defined in the retaining protrusion (121). The rail slot (13) may be stepped, is defined radially through the sidewall, communicates with cavity (12) and has a radial depth, an inner top edge, an inner bottom edge and a supporting tab (131). The supporting tab (131) is formed between and connects to the inner top and bottom edges to strength the sleeve (11), is flush with the outer surface of the sidewall and has a thickness less than the radial depth of the rail slot (13). The guiding slot (14) is defined in the annular bottom edge of the open bottom, is perpendicular to and communicates with the rail slot (13). The limit (15) is formed on and extends upward from the inner bottom edge of the rail slot (13) and is located adjacent to the guiding slot (14).

The arm (17) is formed on and extends radially outward from the sidewall of the sleeve (11) and may hold the antenna of the wireless device.

The pivot (20) is mounted rotatably in the cavity (12) in the sleeve (11) of the bracket (10), holds the bracket (10) and has an open top, a sidewall, a chamber (22) and a slide (23).

The sidewall is annular.

The chamber (22) is defined in the open top and has an inner bottom surface and a retainer protrusion (221). The retainer protrusion (221) is formed on and extends upward from the inner bottom surface of the chamber (22) and has a mounting groove (222) defined in the retainer protrusion (221).

The slide (23) is formed on and extends radially outward from the sidewall of the pivot (20), is mounted slidably in the rail slot (13) through the guiding slot (14) in the sleeve (11), is blocked by the limit (15) and has a thickness. The limit (15) prevents the slide (23) from inadvertently entering the guiding slot (14) and falling out of the sleeve (11). The thickness of the side (23) is less than the radial depth of the rail slot (13) and a sum of the thicknesses of the supporting tab (131) and slide (23) is equal or less than the depth of the rail slot (13) so the slide (23) may slide in the rail slot (23) without interfering with the supporting tab (131).

The spring (30) is mounted between the bracket (10) and the pivot (20), extends in the cavity (12) in the bracket (10) and the chamber (22) in the pivot (20). The spring (30) biases the slide (23) on the pivot (20) to press against the inner bottom edge of the rail slot (13) and be aligned with the limit (15) so the limit (15) can block the slide (23) from entering the guiding slot (14). The spring (30) has two ends and two crossbars (31). The ends of the spring (30) extend respectively in the cavity (12) and the chamber (10) and are mounted respectively around retaining protrusions (121, 221) in the bracket (10) and the pivot (20) so that the spring (30) would not accidentally displace. The crossbars (31) are formed respectively on the ends and are mounted respectively in the mounting grooves (122, 222) in the retaining protrusions (121, 221) so that the spring (30) twists and provides a torsion force to the antenna hinge when the bracket (10) rotates on the pivot (20). With the torsion force, the bracket (10) would not rotate inadvertently.

Figure 6:
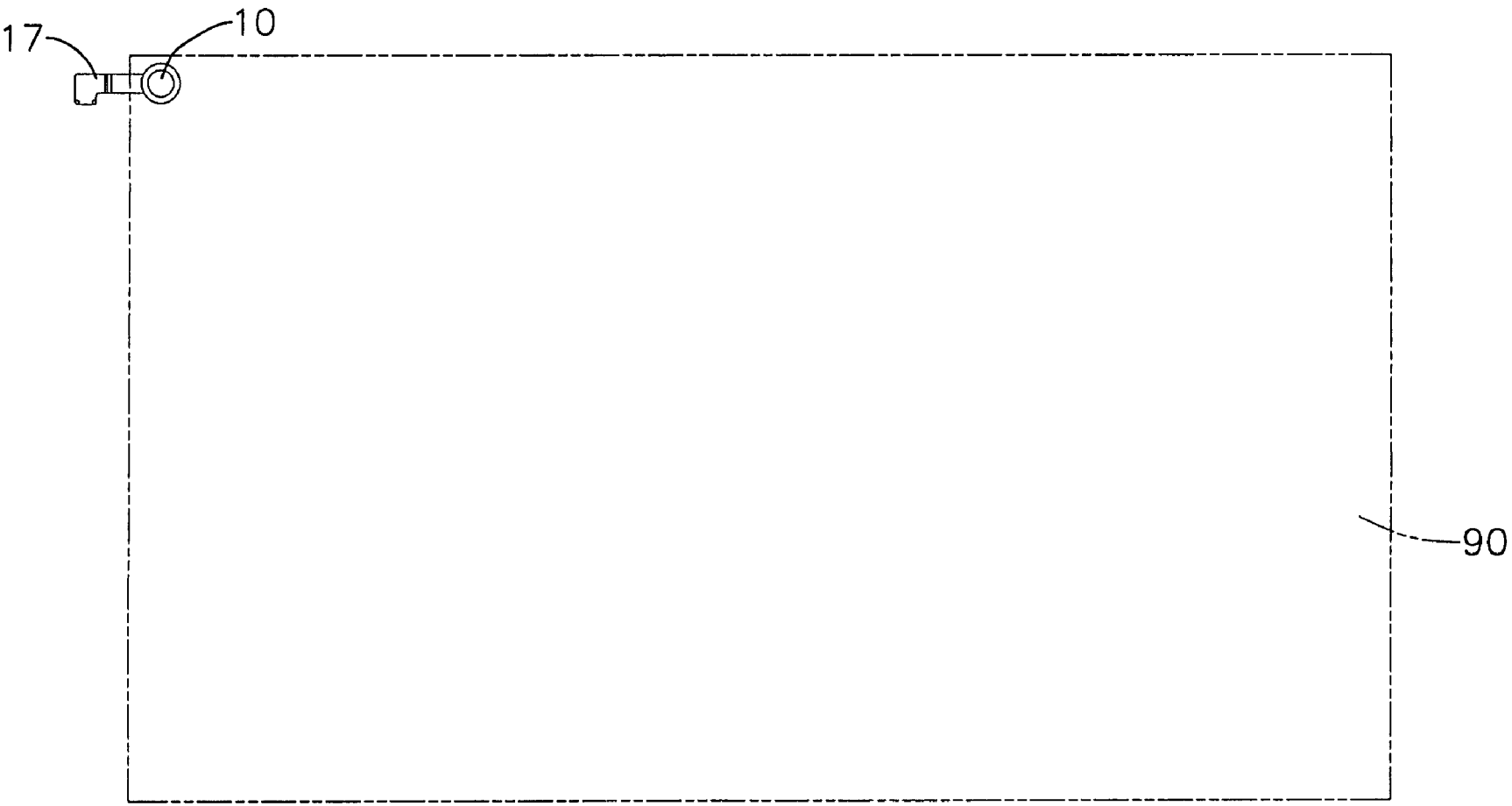
FIG. 6 is an operational view of the bracket of the antenna hinge in FIG. 5 pivoting the on the cover of the notebook.

With reference to FIGS. 5 and 6, the arm (17) on the bracket (10) holds the antenna so that a user merely needs to pivot the arm (17) to adjust an antenna pointing of the antenna instead of moving the whole notebook. With the antenna hinge, the antenna pointing is adjusted easily and conveniently.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An antenna hinge comprising:

a bracket having a sleeve having a open bottom having an annular bottom edge, a sidewall, a cavity defined in the open bottom and a rail slot defined radially through the sidewall and communicating with the cavity; and an arm formed on and extending outward from the sidewall of the sleeve;

a pivot mounted rotatably in the cavity in the sleeve of the bracket, holding the bracket and having an open top, a sidewall, a chamber defined in the open top and a slide formed on and extending radially outward from the sidewall of the pivot and mounted slidably in the rail slot; and a spring mounted between the bracket and the pivot and having two ends extending respectively in the cavity in the bracket and the chamber in the pivot.

2. The antenna hinge as claimed in claim 1, wherein the sleeve of the bracket further has a guiding slot defined in the annular bottom edge of the open bottom, being perpendicular to and communicating with the rail slot.

3. The antenna hinge as claimed in claim 2, wherein the rail slot further has an inner top edge, an inner bottom edge, a limit formed on and extending upward from the inner bottom edge of the rail slot, located adjacent to the guiding slot and preventing the slide on the pivot from entering the guiding slot and falling out of the sleeve.

4. The antenna hinge as claimed in claim 3, wherein:

the cavity in the sleeve of the bracket further has an inner top surface and a retaining protrusion formed on and extending downward from the inner top surface;

the chamber in the pivot further has an inner bottom surface and a retaining protrusion formed on and extending upward from the inner bottom surface; and the ends of the spring are mounted respectively around the retaining protrusions.

5. The antenna hinge as claimed in claim 4, wherein:

each retaining protrusion has a mounting groove; and the spring further has two crossbars formed respectively on the ends and mounted respectively in the mounting grooves.

6. The antenna hinge as claimed in claim 5, wherein:

the sidewall of the sleeve of the bracket has an outer surface;

the slide on the pivot has a thickness;

the rail slot in the sleeve of the bracket further has a radial depth being large than thickness of the slide; and a supporting tab formed between and connecting to the inner top and bottom edges, being flush with the outer surface of the sidewall of the sleeve and having a thickness being less than the radial depth; and a sum of the thicknesses of the supporting tab and the slide is equal or less than the radial depth of the rail slot.

* * * * *